US008106732B2

(12) United States Patent
Takano

(10) Patent No.: US 8,106,732 B2
(45) Date of Patent: Jan. 31, 2012

(54) RELAY

(75) Inventor: Satoshi Takano, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 123 days.

(21) Appl. No.: 12/585,118

(22) Filed: Sep. 3, 2009

(65) Prior Publication Data

US 2010/0052831 A1 Mar. 4, 2010

(30) Foreign Application Priority Data

Sep. 4, 2008 (JP) ..... 2008-227471

(51) Int. Cl.
*H01H 9/02* (2006.01)
*H01H 13/04* (2006.01)

(52) U.S. Cl. ..... 335/202; 335/78; 335/124

(58) Field of Classification Search ..... 335/78–86, 335/124, 128–132, 202
See application file for complete search history.

(56) References Cited

U.S. PATENT DOCUMENTS

| | | | | |
|---|---|---|---|---|
| 5,216,397 | A * | 6/1993 | Matsuoka et al. | 335/83 |
| 7,106,154 | B2 * | 9/2006 | Takano et al. | 335/129 |
| 7,872,551 | B2 * | 1/2011 | Nakamura et al. | 335/4 |
| 2006/0082428 | A1 * | 4/2006 | Suzuki et al. | 335/128 |

FOREIGN PATENT DOCUMENTS

JP 2005-071754 3/2005

* cited by examiner

*Primary Examiner* — Bernard Rojas
(74) *Attorney, Agent, or Firm* — Staas & Halsey LLP

(57) ABSTRACT

A relay includes a base and a switch built into the base. A first terminal that is built into the base, is connected to one end of the switch, and is provided on a bottom of the base, a second terminal that is built into the base, is connected to the other end of the switch, and is provided on the bottom, and a third terminal that is connected to the first terminal in the base, is provided on a top of the base. No other terminal is provided on the top.

4 Claims, 13 Drawing Sheets

RELAY

CROSS-REFERENCE TO RELATED APPLICATION

This application is based upon and claims the benefit of priority of the prior Japanese Patent Application No. 2008-227471, filed on Sep. 4, 2008, the entire contents of which are incorporated herein by reference.

FIELD

A certain aspect of the embodiments discussed herein is related to a relay.

BACKGROUND

A relay, in which an electromagnet and a switch operating with the electromagnet are provided on a common base, has been developed for a purpose of opening and closing of high voltage load. Japanese Patent Application Publication No. 2005-71754 discloses a relay including two substrate terminals and two tab terminals that keeps a given insulation distance between an electromagnet and a switch and increases magnetic attractive force of the electromagnet without increasing of external size.

However, the two tab terminals are difficult to distinguish from each other for a user, when one of the substrate terminals and one of the tab terminals of the relay are used. Therefore, the user may insert the other tab terminal incorrectly into a receptacle. In this case, a circuit connected to the relay may get broken.

SUMMARY

According to an aspect of the present invention, there is provided a relay including a base, a switch built into the base, a first terminal that is built into the base, is connected to one end of the switch, and is provided on a first face of the base, a second terminal that is built into the base, is connected to the other end of the switch, and is provided on the first face, and a third terminal that is connected to the first terminal in the base, and is provided on a second face facing with the first face. A terminal connected to the second terminal in the base is not provided on the second face.

According to another aspect of the present invention, there is provided a relay including a base, a switch built into the base, a first terminal that is built into the base, is connected to one end of the switch, and is provided on a first face of the base, a second terminal that is built into the base, is connected to the other end of the switch, and is provided on the first face, a third terminal that is connected to the first terminal in the base, and is provided on a second face facing with the first face, and a fourth terminal that is connected to the second terminal in the base, and is provided on the second face. Length of the third terminal is different from that of the fourth terminal.

According to another aspect of the present invention, there is provided a relay including a base, a switch built into the base, a first terminal that is built into the base, is connected to one end of the switch, and is provided on a first face of the base, a second terminal that is built into the base, is connected to the other end of the switch, and is provided on the first face, a third terminal that is connected to the first terminal in the base, and is provided on a second face facing with the first face, and a fourth terminal that is connected to the second terminal in the base, and is provided on the second face. One of the third terminal and the fourth terminal is bended.

DESCRIPTION OF EMBODIMENTS

Figure 1:
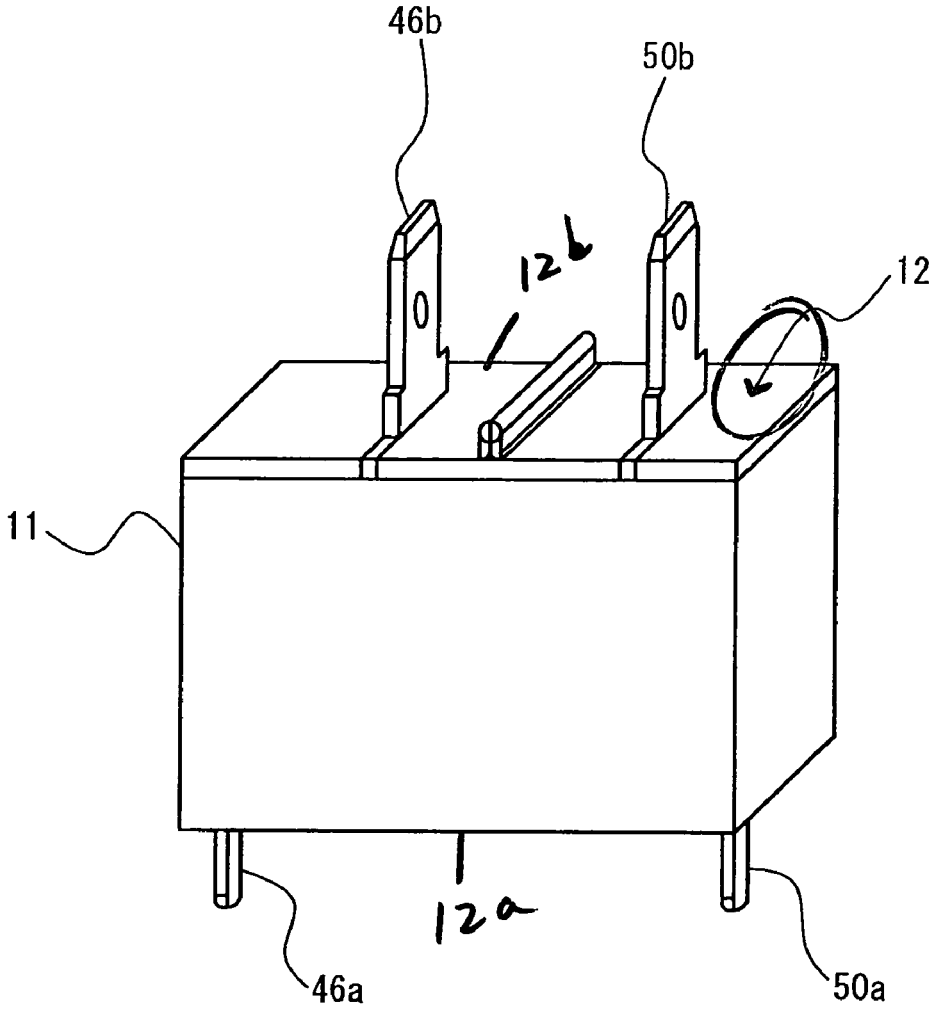
FIG. 1 illustrates a perspective view of a relay having a tab terminal in accordance with a comparative embodiment.

A description will now be given of embodiments of the present invention with reference to the accompanying drawings. In the following description, the same components have the same reference numerals.

A description will be given of a relay in accordance with a comparative embodiment having two substrate terminals and two tab terminals in order to compare the relay with that of the present invention, with reference to FIG. 1 through FIG. 3.

Figure 2:
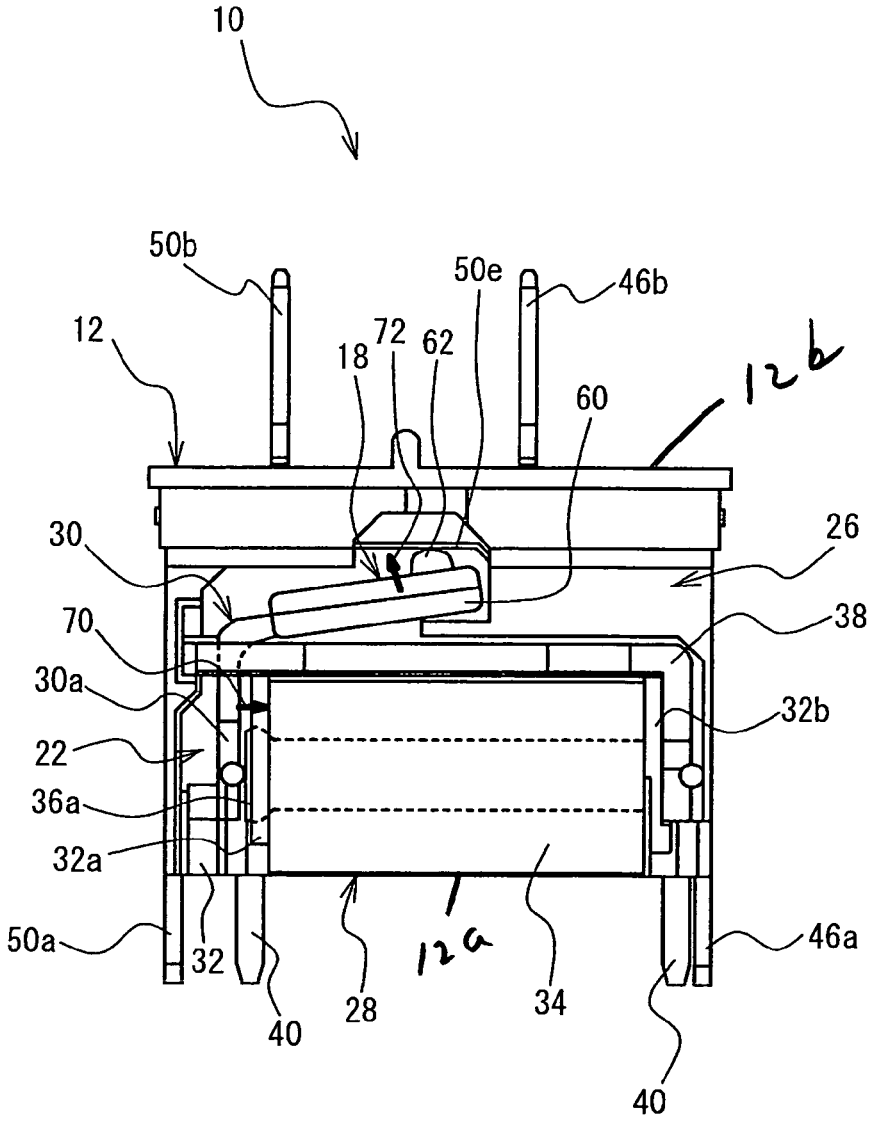
FIG. 2 illustrates a front view of the relay in accordance with the comparative embodiment.
Figure 3:
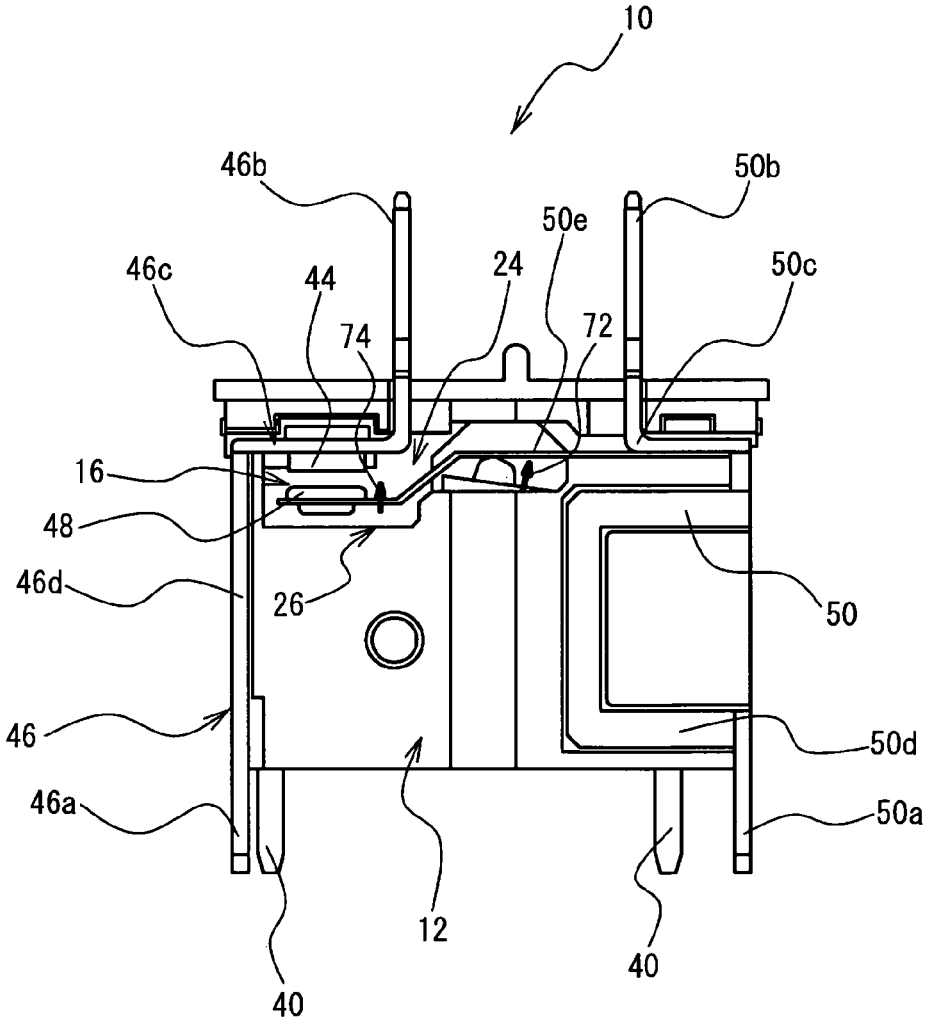
FIG. 3 illustrates a front view of the relay in accordance with the comparative embodiment viewed from a direction opposite to FIG. 2.

FIGS. 1 and 2 illustrates a a relay 10 in accordance with the comparative embodiment. The relay 10 includes a base 12, a hollow box 11, substrate terminals 46*a* and 50*a* , and tab terminals 46*b* and 50*b* . A face 12*a* of the base 12 where the substrate terminals 46*a* and 50*a* are provided acts as a first face. Another face 12*b* of the base 12 where the tab terminals 46band 50bare provided acts as a second face. The substrate terminals 46*a* and 50*a* are connected to a circuit of a print substrate and act as terminals fixed to the print substrate. The substrate terminals 46*a* and 50*a* are, for example, provided at ends of the first face as illustrated in FIG. 1 in order to strengthen connection intensity to the print substrate. The tab terminals 46*b* and 50*b* are terminals fitted into a receptacle. The tab terminals 46*b* and 50*b* are connected to a circuit of another print substrate other than the print substrate to which the substrate terminals 46*a* and 50*a* are connected. The tab terminals 46*b* and 50*b* are spaced from ends of the second face as illustrated in FIG. 1 in order to fit the tab terminals 46*b* and 50*b* into the receptacle.

FIG. 2 illustrates an internal view of the relay 10 without the box 11 viewed from one side. FIG. 3 illustrates the internal view of the relay 10 without the box 11 viewed from an opposite side. As illustrated in FIG. 2 and FIG. 3, the relay 10 includes an electromagnet 28, a switch 16 built into the base 12, a fixed contact member 46, and a moving contact member 50. The fixed contact member 46 and the moving contact member 50 are formed with processes in which a conductive board material is punched out into a given shape and is bended. The substrate terminal 46*a* and the tab terminal 46*b* are a part of the fixed contact member 46. The substrate terminal 50*a* and the tab terminal 50*b* are a part of the moving contact member 50. Therefore, the substrate terminal 46*a* is conducted to the tab terminal 46*b*. The substrate terminal 50*a* is conducted to the tab terminal 50*b*.

A first end portion of the switch 16 is connected to the fixed contact member 46. A second end portion of the switch 16 is connected to the moving contact member 50. The switch 16 closes when a fixed contact 44 of the fixed contact member 46 contacts a moving contact 48 of the moving contact member 50 with the operation of the electromagnet 28. Details are described later.

The relay 10 has above-mentioned structure. Therefore, the relay 10 may be used with selected one of four combinations of the substrate terminal 46*a* and the substrate terminal 50*a*, the tab terminal 46*b* and the tab terminal 50*b*, the substrate terminal 46*a* and the tab terminal 50*b*, and the substrate terminal 50*a* and the tab terminal 46*b*.

A description will be given of each part of the relay 10, with reference to FIG. 2 and FIG. 3.

The base 12 is made of a resin molded component and includes a first concave portion 22 housing the electromagnet 28, a second concave portion 24 housing the switch 16, and a separation wall 26 separating the first concave portion 22 and the second concave portion 24 in an opposite side to each other.

The electromagnet 28 includes a coil frame 32, a coil 34 rolled in the coil frame 32, and an iron core 36*a* (a region inside of the electromagnet 28 illustrated with a broken line) fixed to the coil frame 32. The coil frame 32 is made of resin molded component having electrical insulation, and includes a hollow body, a pair of guards 32*a* and 32*b* connected to both ends of the hollow body in a longitudinal direction thereof, and a pair of coil terminals 40 connected to ends of coil line of the coil.

The coil 34 is rolled around the hollow body of the coil frame 32, and is fixed between the guards 32*a* and 32*b* of the coil frame 32. The iron core 36*a* is, for example, a cylindrical column member made of magnetic steel. A main part of the cylindrical column is housed and fixed in the hollow body of the coil frame 32.

A connection iron 38 forming a magnetic path around the coil 34 is connected and fixed to the iron core 36*a* of the electromagnet 28 by swaging. The connection iron 38 is, for example, a L-shaped board member made of magnetic steel. A shorter board portion of the L-shaped board member extends along the guard 32*b* of the coil frame 32. A longer board portion of the L-shaped board member is spaced from a side of the coil 34 and extends in parallel with the coil 34.

An armature 30 is, for example, a L-shaped member made of magnetic steel. One of board portions (a board portion 30*a*) faces with the iron core 36*a*. The armature 30 operates with the electromagnet 28. The board portion 30*a* of the armature 30 is spaced from the iron core 36*a* by a given distance and is kept still, when the electromagnet 28 is inactive. With magnetic attractive force, the board portion 30*a* of the armature 30 moves around a bending region thereof in a direction along an arrow 70 approaching the iron core 36*a*, when the electromagnet is active.

The switch 16 includes the fixed contact member 46 having the fixed contact 44 and the moving contact member 50 having the moving contact 48. The fixed contact member 46 includes the substrate terminal 46*a* having a pin shape at one end part thereof, the tab terminal 46*b* having a board shape and extending approximately in parallel with the substrate terminal 46*a* at the other end thereof, an intermediate portion 46*c* having a board shape and crossing the substrate terminal 46*a* and the tab terminal 46*b* at approximately right angle, and a foot portion 46*d* having a linear shape and crossing the intermediate portion 46*c* at approximately right angle between the substrate terminal 46*a* and the intermediate portion 46*c*. The fixed contact 44 is made of a given contact member and is fixed to the face of the intermediate portion 46*c* on the substrate terminal 46*a* side by swaging.

The moving contact member 50 includes the substrate terminal 50*a* having a pin shape at one end part thereof, the tab terminal 50*b* having a board shape and extending approximately in parallel with the substrate terminal 50*a* at the other end part thereof, an intermediate portion 50*c* having a board shape and crossing the substrate terminal 50*a* and the tab terminal 50*b* at approximately right angle, and a foot portion 50*d* having a crank shape and crossing the intermediate portion 50*c* at approximately right angle between the substrate terminal 50*a* and the intermediate portion 50*c*. A contact spring element 50*e* made of thin board such as phosphor bronze for spring is connected to the intermediate portion 50*c* by swaging. The contact spring element 50*e* extends in a direction crossing the substrate terminal 50*a* and the tab terminals 50*b* at approximately right angle. The moving contact 48 is made of a given contact material and is fixed to the face of free end area of the contact spring element 50*e* on the tab terminal 50*b* side by swaging.

The fixed contact member 46 is fixed to the base 12 when the intermediate portion 46*c* is inserted into the second concave portion 24 of the base 12. The moving contact member 50 is fixed to the base 12 when the intermediate portion 50*c* and the contact spring element 50*e* are inserted into the second concave portion 24 of the base 12. The fixed contact 44 and the moving contact 48 are spaced from each other by a given distance and face with each other in a vertical direction in FIG. 3 in the second concave portion 24, when the fixed contact member 46 and the moving contact member 50 are fixed to an adequate position on the base 12.

An operation member 18 is a board-shaped member having a bag structure integrally formed of insulating resin material, and is fixed to one of the extending portions of the armature 30 that is farther from the iron core 36*a* of the electromagnet 28. The operation member 18 includes a projection 62 projecting outward in an opposite side of a housing portion 60. The operation member 18 moves in a direction of an arrow 72 or the reverse direction, in conjunction with swinging operation of the armature 30 according to excitation or non-excitation of the electromagnet 28.

A description will be given of an closing operation of the switch 16, with reference to FIG. 2 and FIG. 3.

When the electromagnet is active, the board portion 30*a* of the armature 30 moves with the magnetic extraction force in the direction of the arrow 70 approaching the iron core 36*a* against spring force of the contact spring element 50*e* . Accordingly, the operation member 18 presses the contact spring element 50*e* , moves toward the boundary of swing motion range, and is elastically bent in the direction of the arrow 72 so that the contact spring element 50*e* approaches the fixed contact member 46. The operation member 18 gets to the boundary of the swing motion range when the board portion 30*a* of the armature 30 adsorbs onto the iron core 36*a* completely. The moving contact 48 shifts in the direction of an arrow 74 according to the operation of the operation member 18 and the armature 30, and is conducted to the facing fixed contact 44. Thus, the switch 16 closes.

A description will be given of a combination in which one of the substrate terminals is conducted to one of the tab terminals, in a case where the switch 16 of the relay 10 closes, with reference to FIG. 4, FIG. 5A and FIG. 5B.

Figure 4:
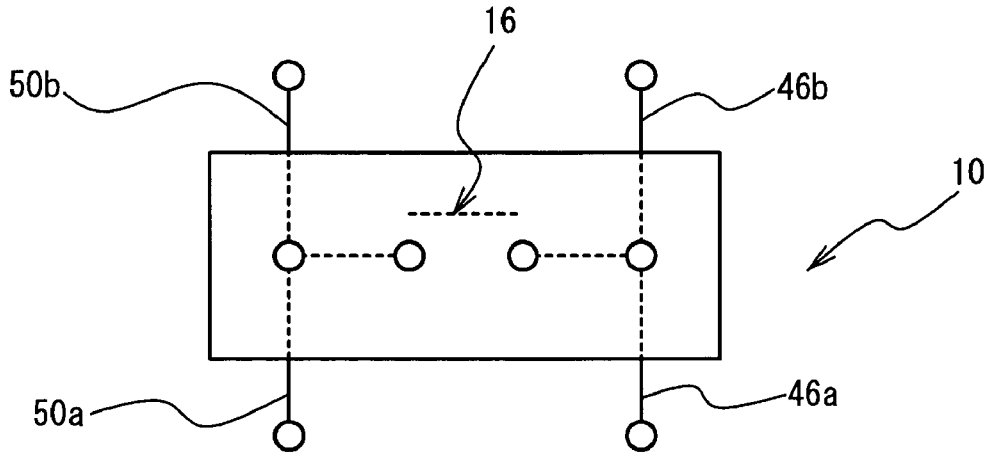
FIG. 4 illustrates a circuit diagram of the relay in accordance with the comparative embodiment.

FIG. 4 illustrates a circuit diagram of the relay 10. The relay 10 includes the substrate terminals 46*a* and 50*a* , the tab terminals 46*b* and 50*b* , and the switch 16, as illustrated in FIG. 4. The switch 16 closes when the electromagnet is active.

Figure 5A:
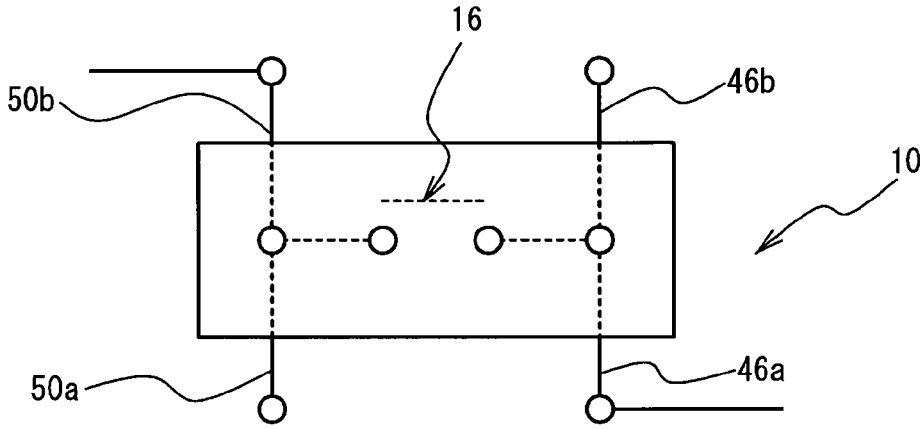
FIG. 5A and FIG. 5B illustrate a combination in which a substrate terminal is conducted to a tab terminal when a switch of the relay in accordance with the comparative embodiment closes.
Figure 5B:
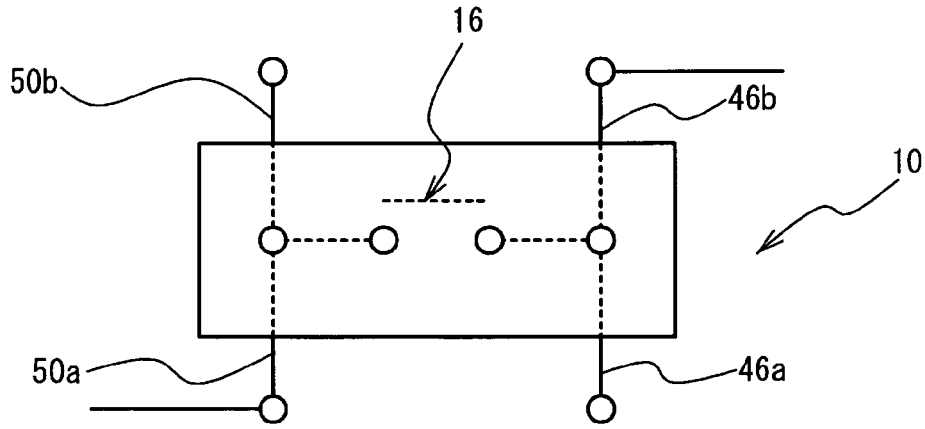

FIG. 5A and FIG. 5B use the circuit diagram of the relay 10 of FIG. 4, and illustrate a combination in which one of the substrate terminals is conducted to one of the tab terminals when the switch 16 of the relay 10 closes. As illustrated in FIG. 5A and FIG. 5B, a combination of the substrate terminal 46*a* and the tab terminal 50*b* and a combination of the substrate terminal 50*a* and the tab terminal 46*b* are conducted, when the switch 16 closes.

Figure 6A:
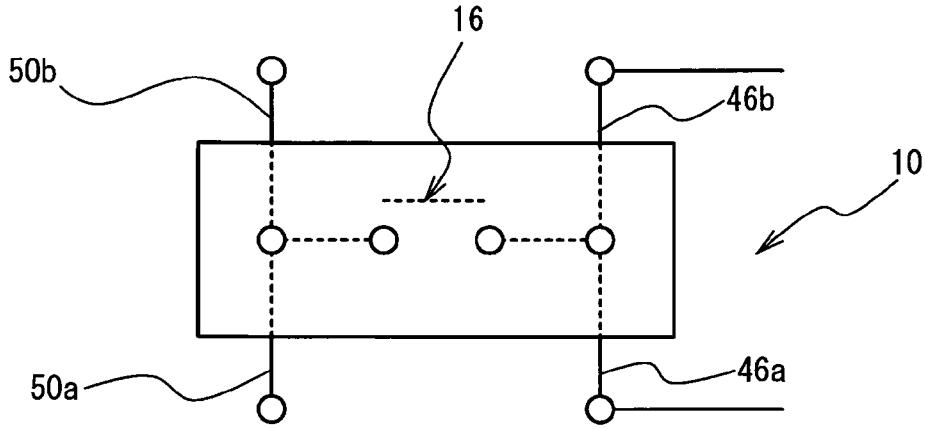
FIG. 6A and FIG. 6B illustrate a combination in which a substrate terminal is conducted to a tab terminal whether the switch of the relay in accordance with the comparative embodiment closes or opens.
Figure 6B:
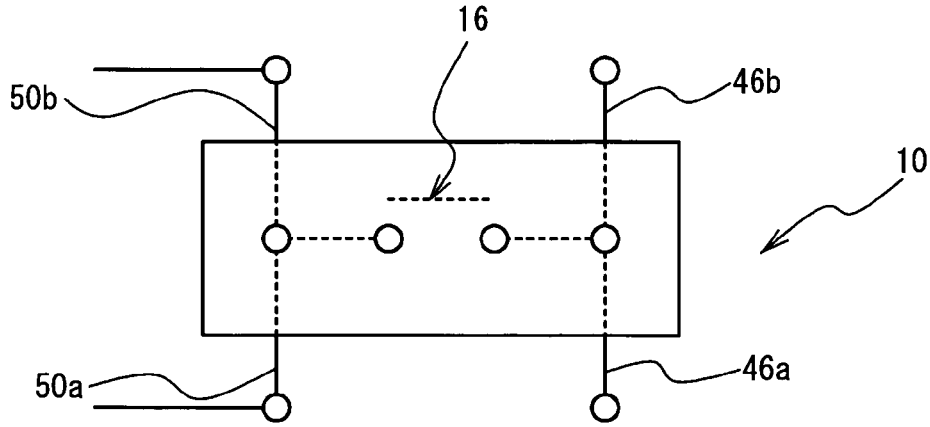

FIG. 6A and FIG. 6B illustrate a combination in which a substrate terminal is constantly conducted to a tab terminal whether the switch 16 of the relay 10 closes or not. As illustrated in FIG. 6A and FIG. 6B, a combination of the substrate terminal 46*a* and the tab terminal 46*b* and a combination of the substrate terminal 50*a* and the tab terminal 50*b* are constantly conducted, respectively, whether the switch 16 closes or not. These combinations of the relay 10 are improper. As illustrated in FIG. 2 and FIG. 3, the substrate terminal 46aand the tab terminal 46*b* are a part of the fixed contact member 46. The substrate terminal 50*a* and the tab terminal 50*b* are a part of the moving contact member 50. Therefore, these combinations are constantly conducted.

The tab terminal 46*b* and the tab terminal 50*b* of the relay 10 have the same length and the same shape, and are arranged on a similar position. The tab terminal 46*b* and the tab terminal 50*b* are difficult to distinguish for a user. There is a case where the user incorrectly selects one of the tab terminals and incorrectly inserts the tab terminal into a receptacle, when one of the substrate terminals and one of the tab terminals are used with the relay 10 being fixed to a print substrate. In this case, the substrate terminal is connected to the tab terminal as illustrated in FIG. 6A and FIG. 6B. Thus, a circuit connected to the relay 10 may be inoperative and may be broken because of heating.

A description will be given of embodiments solving the problem of the comparative embodiment, with reference to the following drawings. Explanations of the same components as the comparative embodiment are omitted.

[First Embodiment]

Figure 7:
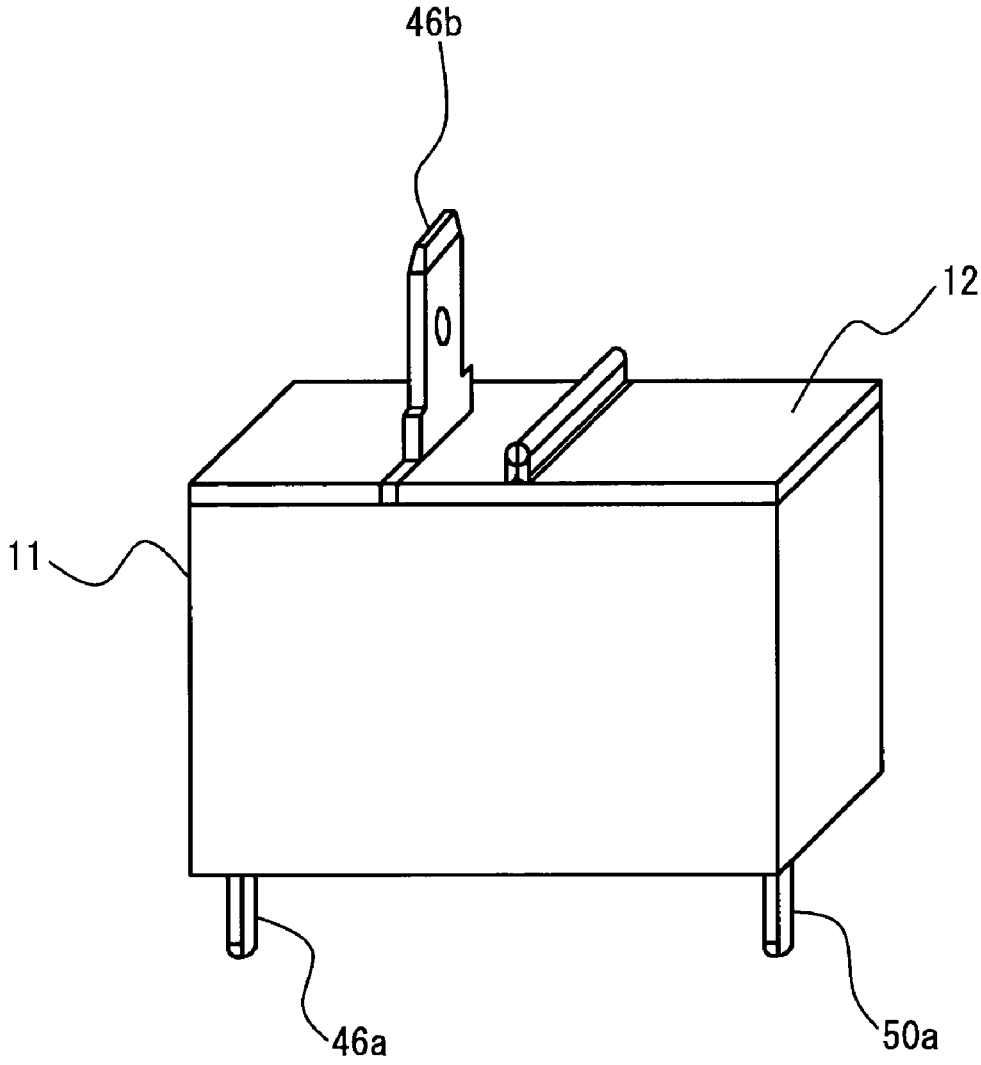
FIG. 7 illustrates a perspective view of a relay in accordance with a first embodiment.
Figure 8:
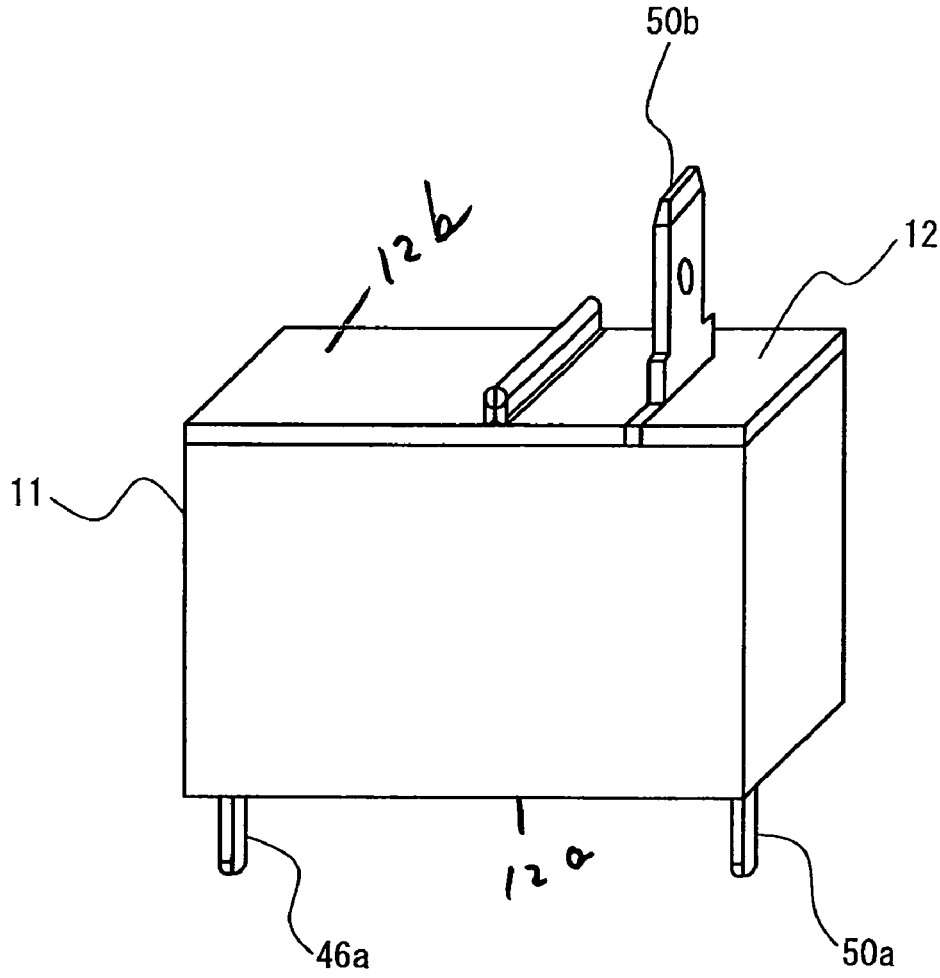
FIG. 8 illustrates a perspective view of the relay in accordance with the first embodiment.

FIG. 7 and FIG. 8 illustrate a perspective view of a relay in accordance with a first embodiment. As illustrated in FIG. 7, the relay in accordance with the first embodiment includes the tab terminal 46*b* that is connected to the substrate terminal 46*a* in the base 12 and is provided on the second face 12*b* facing the first face 12*a* , being different from the comparative embodiment. A terminal connected to the substrate terminal 50*a* in the base 12 is not provided on the second face 12*b* . As illustrated in FIG. 8, the relay in accordance with the first embodiment includes the tab terminal 50*b* that is connected to the substrate terminal 50*a* in the base 12 and is provided on the second face 12*b* facing with the first face 12*a* , being different from the comparative embodiment. A terminal connected to the substrate terminal 46*a* in the base 12 is not provided on the second face 12*b* .

With the structure, a user does not select the incorrect tab terminal. Thus, the incorrect tab terminal is not inserted into the receptacle. Therefore, improper use of the tab terminal of the relay is restrained. And a failure of a circuit connected to the relay is restrained.

In accordance with the first embodiment, the relay includes the tab terminal that is connected to one of the substrate terminals in the base 12 and is provided on the second face 12 *b* . That is, only one of the tab terminals 46*b* and 50*b* is provided on the second face 12*b*.

Therefore, the improper use of the tab terminal is restrained. And, the failure of the circuit connected to the relay is restrained.

[Second Embodiment]

Figure 9:
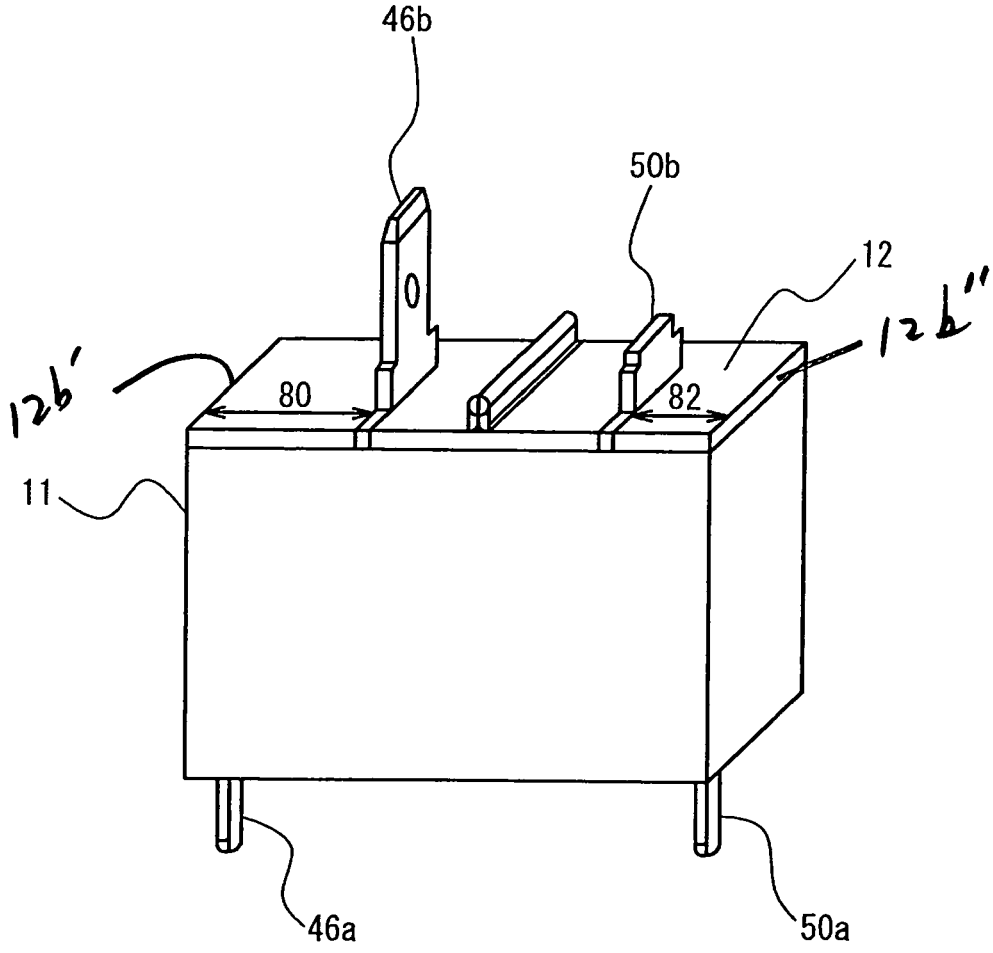
FIG. 9 illustrates a perspective view of a relay in accordance with a second embodiment.
Figure 10:
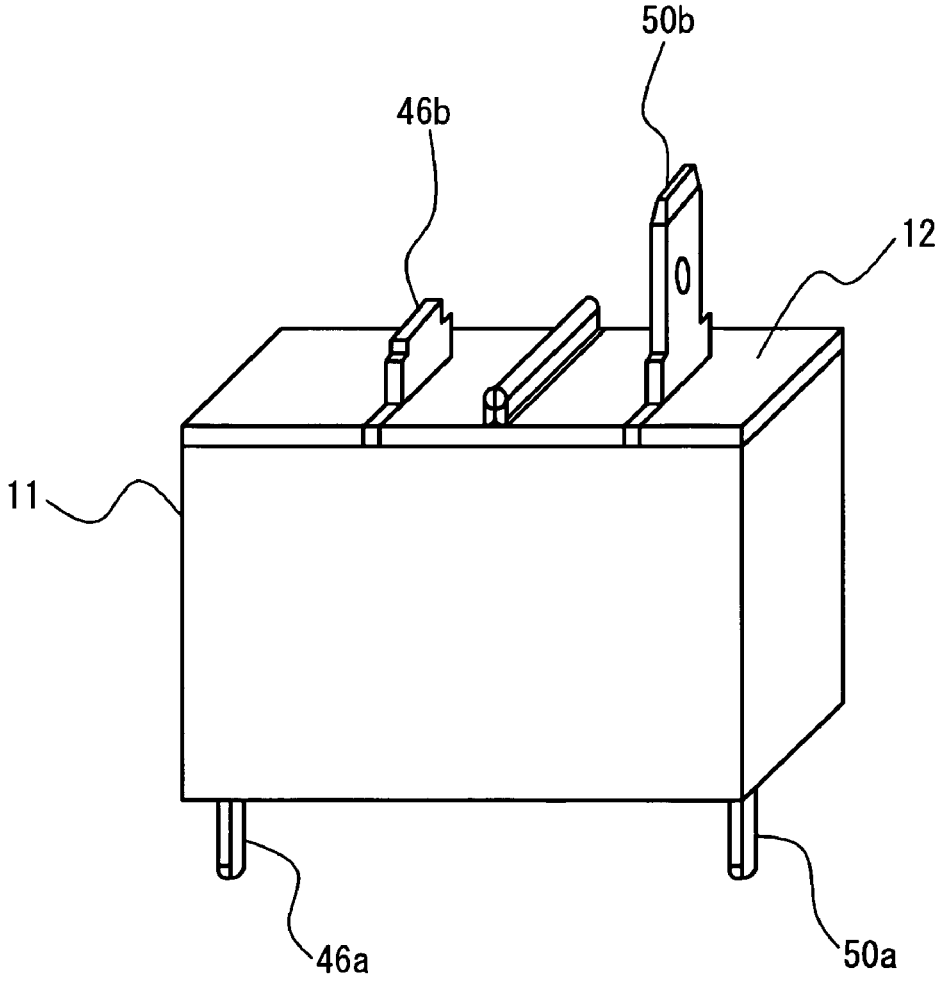
FIG. 10 illustrates a perspective view of the relay in accordance with the second embodiment.

FIG. 9 and FIG. 10 illustrate a perspective view of a relay in accordance with a second embodiment. As illustrated in FIG. 9, in the relay in accordance with the second embodiment, an end part of the tab terminal 50*b* is cut off, and the length of the tab terminal 46*b* is different from that of the tab terminal 50*b*, being different from the comparative embodiment. As illustrated in FIG. 10, in the relay in accordance with the second embodiment, an end part of the tab terminal 46*b* is cut off, and the length of the tab terminal 46*b* is different from that of the tab terminal 50*b* .

The improper use of the tab terminal of the relay is restrained, because a user can distinguish between the two tab terminals 46*b* and 50*b* based on the length. Therefore, a failure of a circuit connected to the relay is restrained.

As illustrated in FIG. 9, in the relay in accordance with the second embodiment, a distance 80 between the tab terminal 46*b* and one end 12*b* 'of the second face 12*b* where the tab terminal 46*b* is provided is different from a distance 82 between the tab terminal 50*b* and the other end 12*b* "of the second face 12*b* where the tab terminal 50*b* is provided.

Therefore, the improper use of the tab terminal of the relay is restrained because a user can distinguish between the two tab terminals 46*b* and 50*b* based on the position in addition to the length. Therefore, the failure of the circuit connected to the relay is restrained.

In accordance with the second embodiment, the length of the tab terminal 46*b* is different from that of the tab terminal 50*b* . Therefore, the improper use of the tab terminal of the relay is restrained. Therefore, a failure of a circuit connected to the relay is restrained.

[Third Embodiment]

Figure 11:
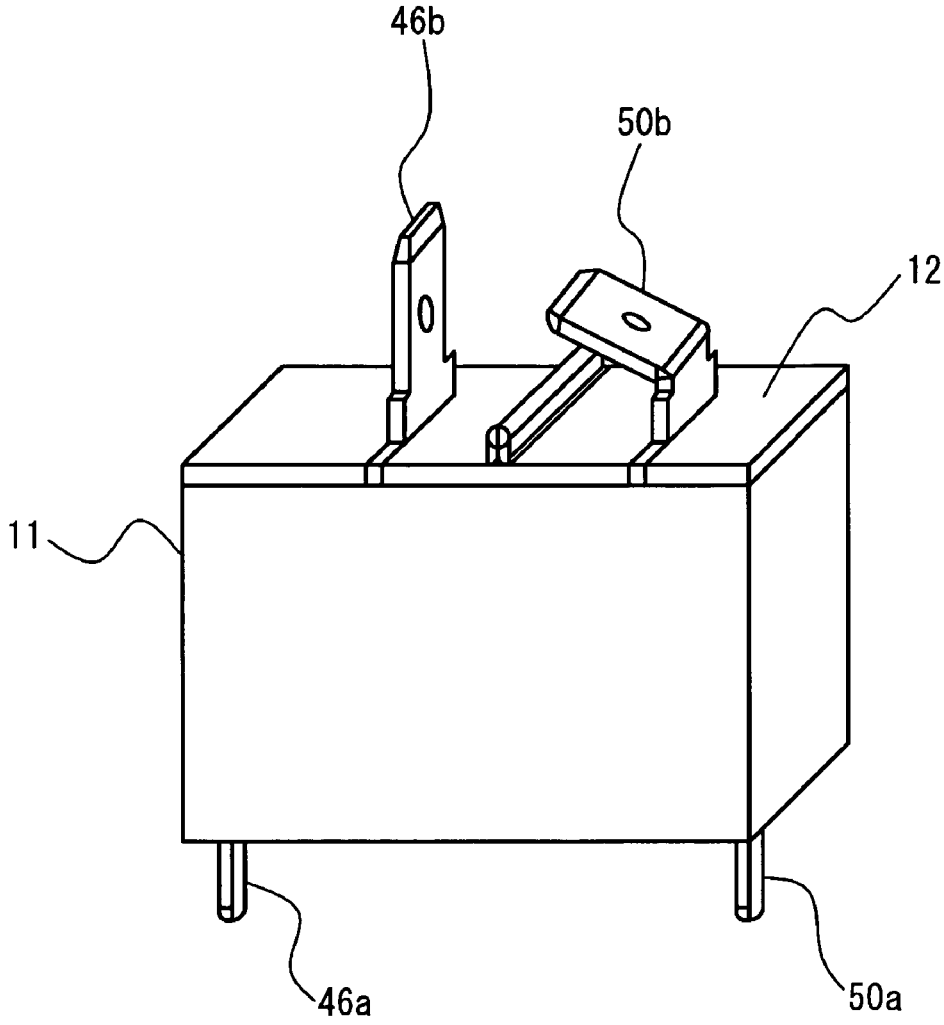
FIG. 11 illustrates a perspective view of a relay in accordance with a third embodiment.
Figure 12:
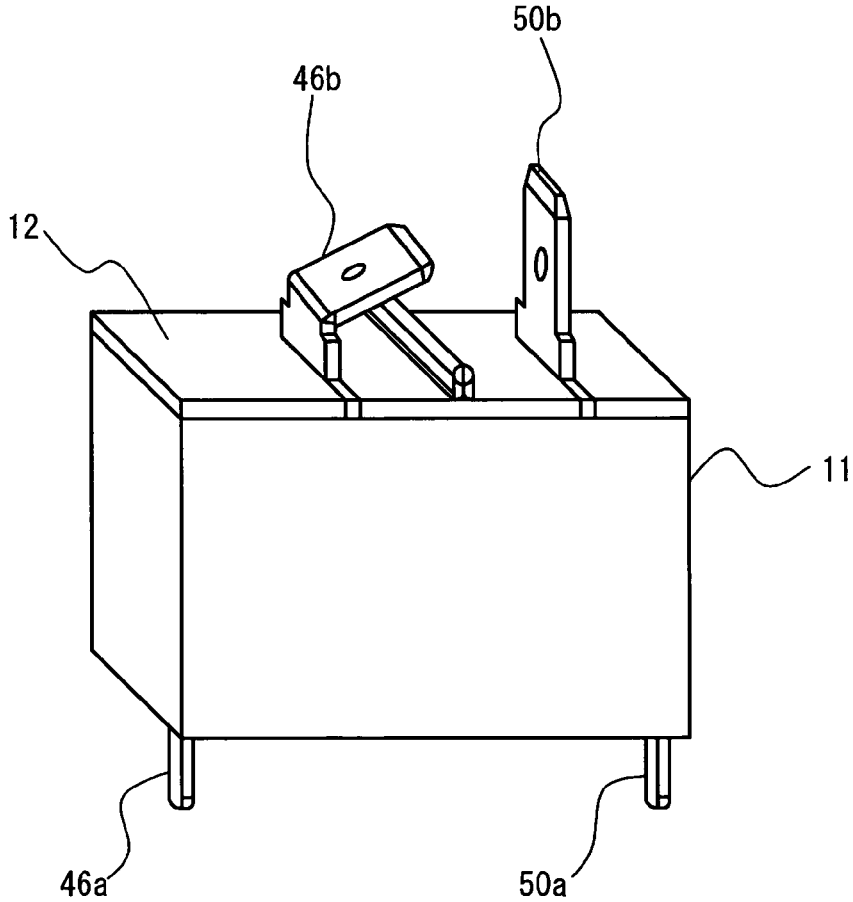
FIG. 12 illustrates a perspective view of the relay in accordance with the third embodiment.

FIG. 11 and FIG. 12 illustrate a perspective view of a relay in accordance with a third embodiment. As illustrated in FIG. 11, in the relay in accordance with the third embodiment, the tab terminal 50*b* is bent, being different from the comparative embodiment. As illustrated in FIG. 12, in the relay in accordance with the third embodiment, the tab terminal 46*b* is bent, being different from the comparative embodiment.

Therefore, the improper use of the tab terminal of the relay is restrained because a user can distinguish between the two tab terminals 46*b* and 50*b* based on the shape. Therefore, the failure of the circuit connected to the relay is restrained.

In accordance with the third embodiment, one of the tab terminals 46*b* and 50*b* is bent. Therefore, the improper use of the tab terminal of the relay is restrained. Therefore, the failure of the circuit connected to the relay is restrained.

[Fourth Embodiment]

Figure 13:
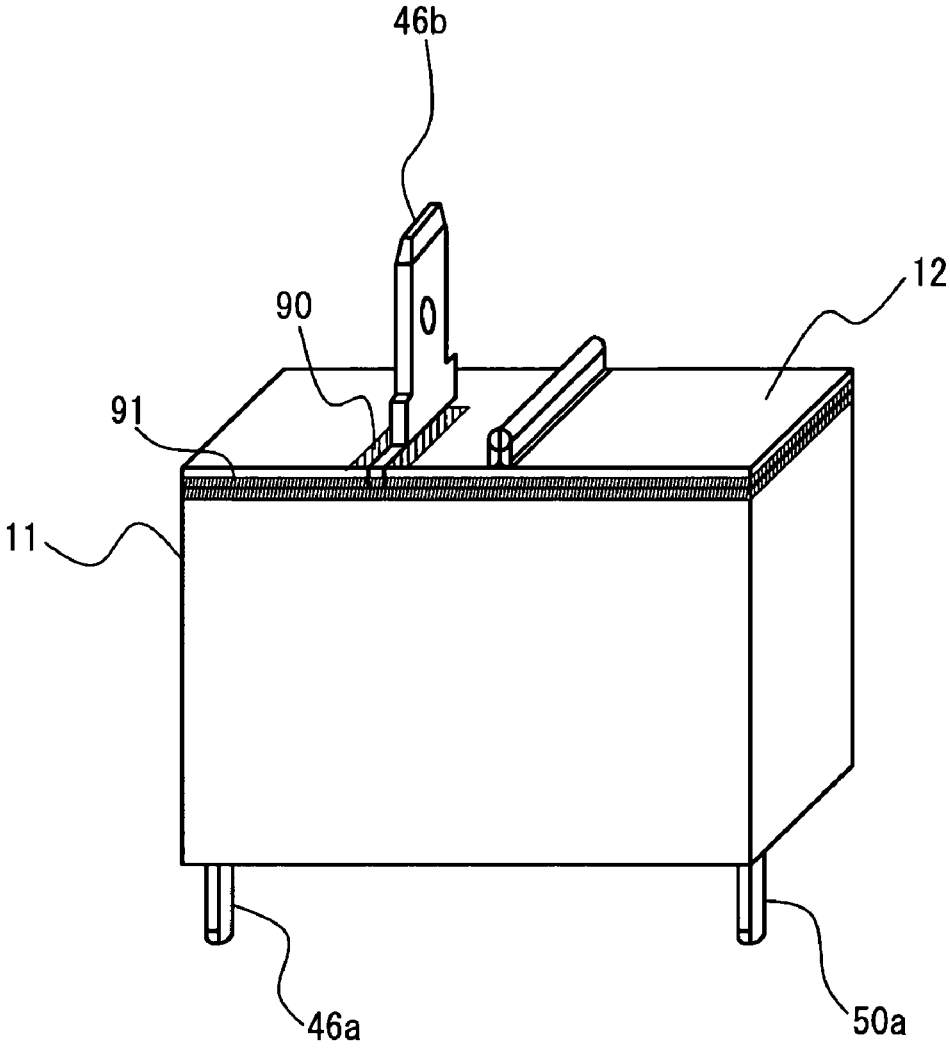
FIG. 13 illustrates a perspective view of a relay in accordance with a fourth embodiment.

FIG. 13 illustrates a perspective view of a relay in accordance with a fourth embodiment. As illustrated in FIG. 13, the relay in accordance with the fourth embodiment is different from the relay in FIG. 7 in a point that a space between the base 12 and the tab terminal 46*b* is filled with an adhesive agent 90. And a space between the base 12 and the box 11 is filled with an adhesive agent 91. Therefore, the improper use of the tab terminal of the relay is restrained. And, a failure of the relay is restrained because intrusion of such as dust, salt, or corrosive gas into the inside of the relay is restrained. Therefore, the failure of the circuit connected to the relay is restrained.

In the fourth embodiment, the adhesive agent 90 is filled between the base 12 and the tab terminal 46*b* acting as the third terminal and between the box 11 and the base 12 in the relay illustrated in FIG. 7. The adhesive agent may be filled one of between the base 12 and the tab terminal 46*b* acting as the third terminal and between the box 11 and the base 12. The adhesive agent may be filled between the base 12 and the tab terminal 50*b* and between the box 11 and the base 12 in the relay illustrated in FIG. 8. The adhesive agent may be filled one of between the base 12 and the tab terminal 50*b* and between the box 11 and the base 12 in the relay illustrated in FIG. 8. The adhesive agent may be filled between the base 12 and the tab terminal 46*b* and between the box 11 and the base 12 in the relays illustrated in FIG. 9 through FIG. 12. The adhesive agent may be filled one of between the base 12 and the tab terminal 46*b* and between the box 11 and the base 12 in the relays illustrated in FIG. 9 through FIG. 12.

In the second embodiment, the distance 80 between the tab terminal 46*b* and the end of the face where the tab terminal is provided is different from the distance 82 between the tab terminal 50*b* and the end of the face where the tab terminal is provided. Similarly, in the third embodiment and the fourth embodiment, a distance between the tab terminal 46*b* and the end of the face where the tab terminal is provided is different form that between the tab terminal 50*b* and the end of the face where the tab terminal is provided.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A relay comprising:

a base having a top, a bottom opposite the top and four sides extending between the top and bottom;

a switch built into the base;

a first terminal that is built into the base, is connected to one end of the switch, and is provided on the bottom;

a second terminal that is built into the base, is connected to another end of the switch, and is provided on the bottom; and a third terminal that is connected to the first terminal in the base, and is provided on the top, wherein no other terminal is provided on the top except for the third terminal.

2. The relay as claimed in claim 1, wherein an adhesive agent is filled at least one of between the base and the third terminal and between the top and the four sides.

3. The relay as claimed in claim 1, wherein the switch operates with an electromagnet built into the base.

4. The relay as claimed in claim 1, wherein the first terminal and the second terminal are connected to a print substrate.

* * * * *